US006846249B2

(12) United States Patent
Lacroix et al.

(10) Patent No.: US 6,846,249 B2
(45) Date of Patent: Jan. 25, 2005

(54) GOLF BALL

(75) Inventors: Matthew K. Lacroix, Granby, MA (US); Mark L. Binette, Ludlow, MA (US); R. Dennis Nesbitt, Beverly Hills, FL (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/667,028

(22) Filed: Sep. 18, 2003

(65) Prior Publication Data

US 2004/0053710 A1 Mar. 18, 2004

Related U.S. Application Data

(63) Continuation-in-part of application No. 10/015,526, filed on Dec. 13, 2001.

(51) Int. Cl.[7] ..... A63B 37/06
(52) U.S. Cl. ..... 473/374
(58) Field of Search ..... 473/371, 374, 473/376, 355, 377

(56) References Cited

U.S. PATENT DOCUMENTS

| | | | | | |
|---|---|---|---|---|---|
| 704,748 | A | * | 7/1902 | Kempshall | 473/373 |
| 728,311 | A | | 2/1903 | Singer | |
| 737,031 | A | | 8/1903 | Short | |
| 1,120,757 | A | | 12/1914 | Steinberger | |
| 1,182,605 | A | * | 5/1916 | Wadsworth | 473/369 |
| 2,859,968 | A | | 11/1958 | Modica, Jr. | |
| 3,313,545 | A | | 4/1967 | Bartsch | |
| 3,373,123 | A | | 3/1968 | Brice | |
| 3,384,612 | A | | 5/1968 | Brandt et al. | |
| 3,819,190 | A | | 6/1974 | Nepela et al. | |
| 3,874,663 | A | | 4/1975 | Kahle | |
| 4,058,310 | A | | 11/1977 | Mietlinen | |
| 4,173,345 | A | * | 11/1979 | Pocklington | 473/377 |
| 4,194,737 | A | | 3/1980 | Farmer | |
| 4,229,401 | A | * | 10/1980 | Pocklington | 264/248 |
| 4,274,637 | A | | 6/1981 | Molitor | |
| 4,332,102 | A | | 6/1982 | Caffrey | |
| 4,609,196 | A | | 9/1986 | Bozinovic | |
| 4,664,387 | A | | 5/1987 | Tardiff | |
| 4,679,795 | A | | 7/1987 | Melvin et al. | |
| 4,863,167 | A | | 9/1989 | Matsuki et al. | |
| 4,974,511 | A | | 12/1990 | Hsi-Chou | |
| 5,026,067 | A | | 6/1991 | Gentiluomo | |
| 5,104,126 | A | | 4/1992 | Gentiluomo | |
| 5,306,760 | A | | 4/1994 | Sullivan | |
| 5,312,857 | A | | 5/1994 | Sullivan | |
| 5,358,448 | A | | 10/1994 | Stephens | |
| 5,688,869 | A | | 11/1997 | Sullivan | |
| 5,779,562 | A | | 7/1998 | Melvin et al. | |
| 5,779,563 | A | | 7/1998 | Yamagishi et al. | |
| 5,779,564 | A | | 7/1998 | Nakamura et al. | |
| 5,807,192 | A | | 9/1998 | Yamagishi et al. | |
| 5,846,141 | A | | 12/1998 | Morgan et al. | |
| 5,876,294 | A | | 3/1999 | Yamagishi et al. | |
| 5,899,822 | A | | 5/1999 | Yamagishi et al. | |
| 5,984,806 | A | | 11/1999 | Sullivan et al. | |
| 5,984,807 | A | * | 11/1999 | Wai et al. | 473/376 |
| 6,004,225 | A | | 12/1999 | Owens et al. | |
| 6,010,412 | A | | 1/2000 | Moriyama | |
| 6,033,611 | A | * | 3/2000 | Yamaguchi | 264/250 |
| 6,045,460 | A | | 4/2000 | Hayashi et al. | |
| 6,048,279 | A | | 4/2000 | Masutani | |
| 6,117,025 | A | | 9/2000 | Sullivan | |

(List continued on next page.)

*Primary Examiner*—Raeann Gorden

(57) ABSTRACT

A golf ball is provided having a controlled weight distribution about a designated spin axis. The golf ball includes a core and mantle assembly defining one or more high density regions interiorly disposed along a common plane and centered about the horizontal spin axis of the ball. As a result of the controlled weight distribution, the resulting ball significantly reduces hooks and slices. A method of manufacturing and/or utilizing the present golf ball is also provided.

18 Claims, 3 Drawing Sheets

U.S. PATENT DOCUMENTS 6,120,393 A 9/2000 Sullivan et al.
6,142,887 A 11/2000 Sullivan et al.
6,174,247 B1 1/2001 Higuchi et al.
6,180,722 B1 1/2001 Dalton et al.
6,193,618 B1 2/2001 Sullivan et al.
6,196,937 B1 3/2001 Kuttappa
6,244,977 B1 6/2001 Sullivan et al.
6,261,193 B1 7/2001 Sullivan et al.
6,277,034 B1 8/2001 Nesbitt et al.
6,299,550 B1 10/2001 Molitor et al.
6,309,312 B1 10/2001 Sullivan et al.
6,315,681 B1 11/2001 Sullivan
6,485,378 B1 * 11/2002 Boehm ..... 473/374

* cited by examiner

GOLF BALL

CROSS REFERENCES TO RELATED APPLICATIONS

The present application is a continuation-in-part of U.S. application Ser. No. 10/015,526, filed Dec. 13, 2001.

FIELD OF THE INVENTION

The present invention relates to golf balls which exhibit the ability to correct their flight path during flight. More particularly, the present invention relates to golf balls of improved construction having a controlled weight distribution about a designated spin axis. The weight distribution imparts stable spin characteristics to the golf ball and corrects side spin caused when the ball is not squarely hit. The present invention is also directed to a method for producing a golf ball having a controlled weight distribution about a designated spin axis.

BACKGROUND OF THE INVENTION

Generally, there are at least three different types of golf balls that are currently commercially available. These are one-piece balls, multi-piece solid balls having two or more solid pieces or components, and wound balls.

The one-piece ball typically is formed from a solid mass of moldable material which has been cured to develop the necessary degree of hardness. The one-piece ball possesses no significant difference in composition between the interior and exterior of the ball. These balls do not have an enclosing cover. They are utilized frequently as range balls or practice balls. One piece balls are described, for example, in U.S. Pat. Nos. 3,313,545; 3,373,123; and 3,384,612.

Conventional multi-piece solid golf balls, on the other hand, include a solid resilient center or core comprising a single or multiple layer of similar or different types of materials. The core is enclosed with a single or multi-layer covering of protective material.

The one-piece golf ball and the solid core for a multi-piece solid (non-wound) ball frequently are formed from a combination of materials such as polybutadiene and other rubbers cross-linked with zinc diacrylate (ZDA) or zinc dimethacrylate (ZDMA), and optionally containing fillers and curing agents. The cores are molded under high pressure and temperature to provide a ball of suitable hardness and resilience. For multi-piece non-wound golf balls, the cover typically contains a substantial quantity of thermoplastic or thermoset materials that impart toughness and cut resistance to the covers while also providing good playability and distance characteristics. Examples of suitable cover materials include ionomer resins, polyurethanes, polyisoprenes, and nylons, among others.

The wound ball is frequently referred to as a "three-piece" ball since it is produced by winding vulcanized rubber thread under tension around a solid or semi-solid center to form a wound core. The wound core is thereafter enclosed in a single or multi-layer covering of tough protective material. For many years the wound ball satisfied the standards of the U.S.G.A. and was desired by many skilled, low handicap golfers.

The three piece wound ball typically has a cover comprising balata, ionomer or polyurethane like materials, which is relatively soft and flexible. Upon impact, it compresses against the surface of the club producing high spin. Consequently, the soft and flexible covers along with wound cores provide an experienced golfer with the ability to apply a spin to control the ball in flight in order to produce a draw or a fade, or a backspin which causes the ball to "bite" or stop abruptly on contact with the green. Moreover, the cover produces a soft "feel" to the low handicap player. Such playability properties of workability, feel, etc., are particularly important in short iron play and at low swing speeds and are exploited significantly by highly skilled players.

However, a three-piece wound ball has several disadvantages. For example, a soft wound (three-piece) ball is not well suited for use by the less skilled and/or medium to high handicap golfer who cannot intentionally control the spin of the ball. In this regard, the unintentional application of side spin by a less skilled golfer produces hooking or slicing. The side spin reduces the golfer's control over the ball as well as reduces travel distance. Consequently, the impact of an unintentional side spin often produces the addition of unwanted strokes to the golfer's game.

The above described golf balls have been developed and designed by various golf ball manufacturers to be generally uniform in consistency. In essence, the different layers are designed to be relatively uniform in composition and the covers or centers are essentially centered in the middle of the ball. The center of gravity ("COG") of these commercial balls is very desirably at the center point of the ball.

Unlike the conventional balls briefly described above, the balls of the present invention are not uniform in consistency. The balls of this invention have been specifically designed to produce a controlled weight distribution about a designated spin axis. It has been found that this selectively controlled weight distribution imparts a spin stabilization effect about the ball's spin axis. Such a selected weight distribution also corrects the undesired side spin that is produced when the ball is incorrectly struck or mishit with a golf club.

In this regard, when a ball is properly struck, the ball will rise in flight towards the intended direction of travel. This is due to the transformation of forces from the club to the ball and the lift produced by the ball which is back spinning in the air. After being properly struck, the ball will spin about an axis horizontal to the ground ("horizontal axis") such that the bottom of the ball moves in the direction of flight and the top moves opposite to the direction of travel. This results in the ball back spinning in the air in the direction of travel about an axis of rotation or spin axis. As the ball spins (i.e. backspins) in flight, the ball lifts into the air. The addition of dimples or surface depressions in the ball surface further increases the lifting forces by creating localized areas of turbulence.

However, when a ball is improperly struck (i.e. the club face is not traveling in the same direction that it is desired for the ball to take), a side spin is also imparted on the ball. When this occurs, the ball is forced to one side or another of a desired flight path resulting in a curved flight known as "hook" or "slice." Such a curved flight pattern is generally undesirable by the average golfer.

Accordingly, the present invention is directed to improved golf ball components and golf balls employing the same, which have a weight distribution that produces a preferred spin axis. The preferred spin axis is perpendicular to a gyroscopic center plane and corrects side spin imparted by striking the ball with an open or closed club face. These and other objects and features of the invention will be apparent from the following summary of the invention, description of the preferred embodiments, the drawings and from the claims.

SUMMARY OF THE INVENTION

One of the objects of the present invention is to provide a self-correcting golf ball which reduces the hooks and slices produced when the ball is mis-hit. The golf ball has the ability to correct its flight path by re-orienting itself along a central axis during flight.

More particularly, the present invention is directed to a golf ball comprising at least one high-density region centered about the spin or rotational axis of the ball. The region is positioned in the ball along the ball's gyroscopic center plane. The center plane is perpendicular to the desired or designated spin or rotational axis of the ball.

In this regard, it is rare during play that a golf ball exhibits pure backspin (rotation about a horizontal axis in flight) or pure sidespin (rotation about a vertical axis in flight). Instead, the actual spin of a ball during flight is a combination of these spin characteristics. Consequently, during flight, a golf ball will typically spin about a tilted axis that is oriented at some angle.

In the present invention, the ball produces a stabilized spin in flight, even if mishit. By utilizing a controlled weight distribution, the ball will reorient its spin pattern in flight.

As described in greater detail herein, the present invention preferably features a multi-layer golf ball construction comprising at least a core, mantle, and cover layer. A core is utilized which features a body having a recess or recessed channel extending about its outer periphery along a common plane. During formation of the golf ball, the channel is filled with composite mantle material having a specific gravity which is preferably greater than that of the core. In certain even more preferred embodiments, the channel has particular dimensions. The channel can vary in depth and width to maximize the self-correcting function and durability features of the ball. The mantle is further encapsulated by an outer cover layer.

Additionally, the ball of the invention can be optionally designed to exhibit enhanced distance. Specifically, the C.O.R. of the ball can be increased by the removal of excess weighting material compounded into the core and repositioning the removed weight by alternative materials at a distance radially outward from the core.

In a further aspect, the present invention provides a golf ball exhibiting controlled spin characteristics. The golf ball comprises a generally spherical core component in which the core defines a recess or recessed channel extending about the outer circumference of the core along a common plane. The recessed channel defined in the core component has a depth of from about 0.050 inches to about 0.300 inches, preferably of from about 0.040 inches to about 0.250 inches, most preferably from about 0.030 inches to about 0.200 inches.

The golf ball also comprises a mantle layer disposed on and uniformly encapsulating the core. The mantle layer extends into the channel and has a greater specific gravity than that of the core. This forms, in part, a weighted, longitudinal band extending about the core. The golf ball further comprises a cover disposed on and about the mantle layer. The cover has an outer surface and defines a plurality of dimples along the outer surface.

In yet another aspect, the present invention provides a self-correcting golf ball exhibiting improved spin characteristics. The golf ball comprises a generally spherical core component in which the core defines a recess or recessed channel extending about its outer periphery along a common plane. The channel is aligned with, and forms, the ball's gyroscopic center plane and is centered about the ball's spin axis. The recessed channel defined in the core component has a width of from about 0.100 inches to about 0.500 inches, more preferably from about 0.100 inches to about 0.250 inches and most preferably from about 0.100 inches to about 0.200 inches.

The golf ball further comprises a mantle layer disposed on and encapsulating the core. The mantle layer extends into and fills the recessed channel and has a specific gravity that is greater than that of the core. In such an embodiment, lighter cores are utilized and heavy weight filler materials are included in the mantle compositions. The golf ball further comprises a cover disposed on the mantle layer to form a solid, non-wound golf ball. The cover has an outer surface and defines a plurality of dimples along the outer surface.

The weighted channel formed within the core of the golf ball of this embodiment assists in the orientation of the core during ball flight. As the ball finds the central axis, it will correct its flight path.

In a still further aspect, the present invention provides a golf ball exhibiting improved spin characteristics. The golf ball comprises a generally spherical core component. The core defines a recessed channel extending about an outer periphery and along the circumference of the core along a common plane. The recessed channel can be formed by removing (such as by cutting, ablation, and so forth) material from a molded spherical core or by being shaped or formed during the molding process using an appropriately shaped mold. For example, the core can be molded in a cavity that has been formed to make the channel aligned with or perpendicular to the core equator. Use of a cavity that has been formed to make a channel perpendicular to the core equator avoids core removal difficulties, etc., produced by molding the channel at the equator of the core.

The golf ball further comprises a mantle layer disposed on and encapsulating the core. The mantle layer extends into and fills the channel of the core and is preferably comprised of a composite material having a higher specific gravity than the core. As a result, the channel is positioned in the core about the ball's spin axis in such a manner to produce a gyroscopic center plane.

The specific gravity of the mantle layer is from about 0.60 to about 8.0, more preferably from about 0.85 to about 7.0, and most preferably about 0.90 to about 6.0 or more than the specific gravity of the core component.

The golf ball further comprises a cover molded about the mantle and core assembly. The cover has an outer surface and defines a plurality of dimples along the outer surface.

The golf ball of this embodiment of the invention corrects for side spin, which is often unintentionally imparted to the ball when the ball is struck with the club face either open (which causes slicing of a conventional golf ball) or closed (which causes hooking of a conventional golf ball). This is because the ball of the present invention will revert to the stable, gyroscopic spin axis during spin decay.

More particularly, when the ball of this embodiment of the invention is first struck by a club head, the ball will spin about various axes caused by deviations in the center of gravity, the geometrical center of the ball, etc. However, shortly thereafter, due to the positioning of the high-density materials in the gyroscopic center plane, the ball will spin backwards about a steadying axis, thereby reducing side spin.

In yet another aspect, the present invention provides a self-correcting, multi-piece golf ball that features a core with a molded-in, recessed channel. Composite mantle materials of different specific gravities are utilized to produce a golf ball having the ability to correct its flight path by reorienting itself along a central axis during flight.

The golf ball comprises a generally spherical core component with a molded-in, recessed channel extending about its outer periphery and along its circumference along a common plane. The core component may consist of one or more layers. The golf ball also comprises a mantle layer disposed on and encapsulating the core. The mantle layer extends into the recessed channel of the core. The golf ball further comprises a cover disposed on the mantle layer. The cover may comprise of one or more layers. The cover has an outer surface and defines a plurality of dimples along the outer surface. The specific gravity of the core component can be greater or lesser than the specific gravity of the mantle layer. This is dependent upon the degree of ball correction desired and the other characteristics and/or features of the finished ball.

In a further aspect, the present invention provides a method of forming a multi-layer golf ball having improved spin characteristics. The method comprises a step of providing a material suitable for forming a golf ball core. The method also includes a step of forming a core from that material such that the core provides a recessed, equatorial or longitudinal channel extending about an outer periphery and along the circumference of the core along a common plane. The method additionally includes a step of forming a mantle layer on the core such that a portion of the mantle layer is disposed within the recessed channel. The core and mantle layers differ in specific gravity in an amount sufficient enough to cause the weighted channel to reorient the ball in flight. The method also includes a step of forming a cover layer on the mantle layer.

This method produces a golf ball having stabilization gyroscopic characteristics. That is, regardless of the initial orientation of the ball prior to striking with a club, once struck, the axis of rotation of the ball will change until the axis is perpendicular to the common plane of the channel. This gyroscopic characteristic is beneficial in that it stabilizes the spinning ball and greatly reduces the tendency for the ball to hook or slice.

It may be desirable for putting purposes to stamp an arrow on the outside of the golf ball indicating the location of the internal weighted band. When putting, the ball is placed on the green with the arrow pointing in the direction of the hole. This method will improve the stability and putting accuracy during play.

These and other aspects, features and objects of the invention will be described in more detail below.

BRIEF DESCRIPTION OF THE DRAWINGS

The following is a brief description of the drawings, which are presented for the purposes of illustrating the invention and not for the purposes of limiting the same.

FIG. 1 illustrates a preferred mantle and core configuration utilized in this preferred embodiment ball.

DETAILED DESCRIPTION OF THE PREFERRED EMBODIMENTS

The present invention relates to a self-correcting golf ball and more particularly to improved components for golf ball construction and the resulting golf balls produced therefrom having controllable flight characteristics. Specifically, according to the invention, golf balls having improved spin stability are provided. The subject golf balls have a high-density material in at least one component or layer that is selectively distributed to provide a spin-stabilizing, gyroscopic center plane.

The golf balls of the present invention optionally conform to limitations such as size, weight, and others, for example, as specified by the United States Golf Association (USGA), or in accordance with other promulgated or de facto standards. However, since several embodiments of the self-correcting golf ball of the subject invention are particularly beneficial to beginning and average golfers, it is also advantageous to such golfers that these embodiments be made in excess of USGA or other standards. For example, in certain embodiments where increased distance is desired, the subject golf ball can be optionally made in excess of the USGA maximum weight and/or be of a smaller than standard size.

The golf balls of the present invention utilize a selected weight distribution which provides a gyroscopic center plane that stabilizes the spin about a spin axis perpendicular to the center plane. In certain embodiments, the high-density material is applied in various configurations to form high-density regions or longitudinal bands of material which are centered about an equatorial plane of the golf ball. The high density regions or longitudinal bands of material form a gyroscopic center plane of the ball. The high-density material is preferably incorporated into the selected region or regions of a mantle layer or other intermediate layer of the golf ball.

As used herein, the term "high-density material" refers to materials having relatively high densities, i.e., that are heavy or have a specific gravity greater than the base polymeric material of the golf ball component. Preferably, the high-density materials have a specific gravity greater than 1.05, more preferably greater than 1.15, and most preferably greater than 1.20.

The golf balls of the present invention utilize a core which comprises a single core component or layer, or a multi-layer core configuration having two or more core layers. The core or outer core layer defines a recessed channel extending about the outer circumference of the core along a common plane. A mantle layer is uniformly formed about the core or core assembly. The mantle extends into the recessed channel and has a specific gravity preferably greater than the core. A cover comprising one or more layers is subsequently molded about the mantle and core assembly to form a solid, non-wound golf ball.

Figure 1:
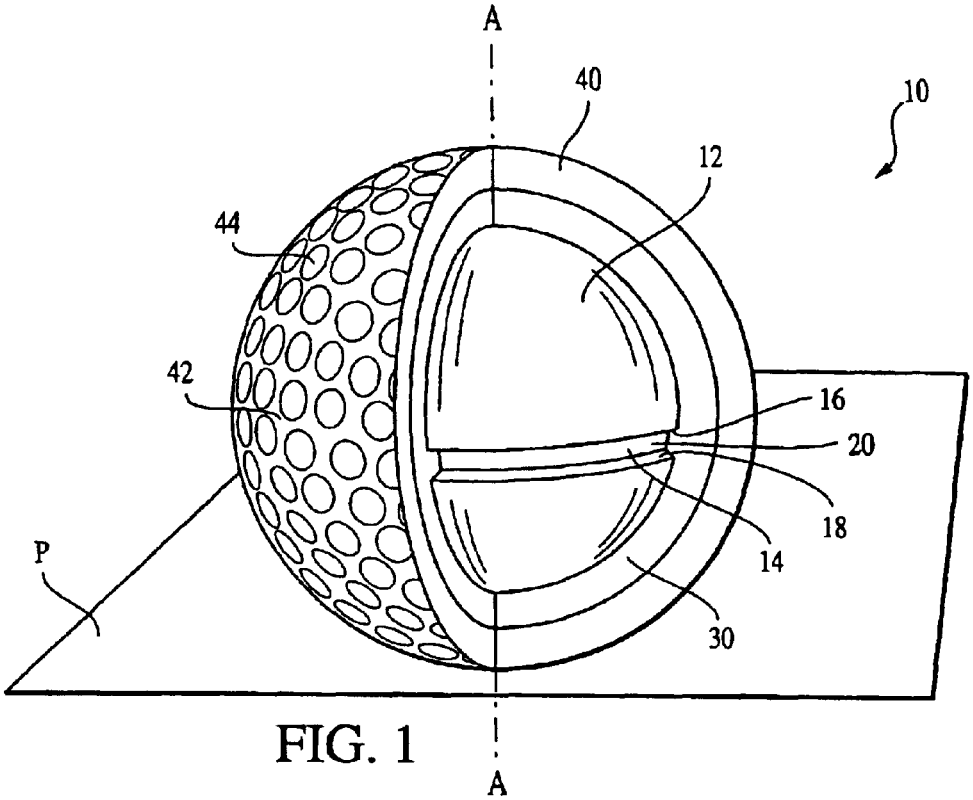
FIG. 1 is a partial sectional view of a preferred embodiment golf ball in accordance with the present invention.
Figure 2:
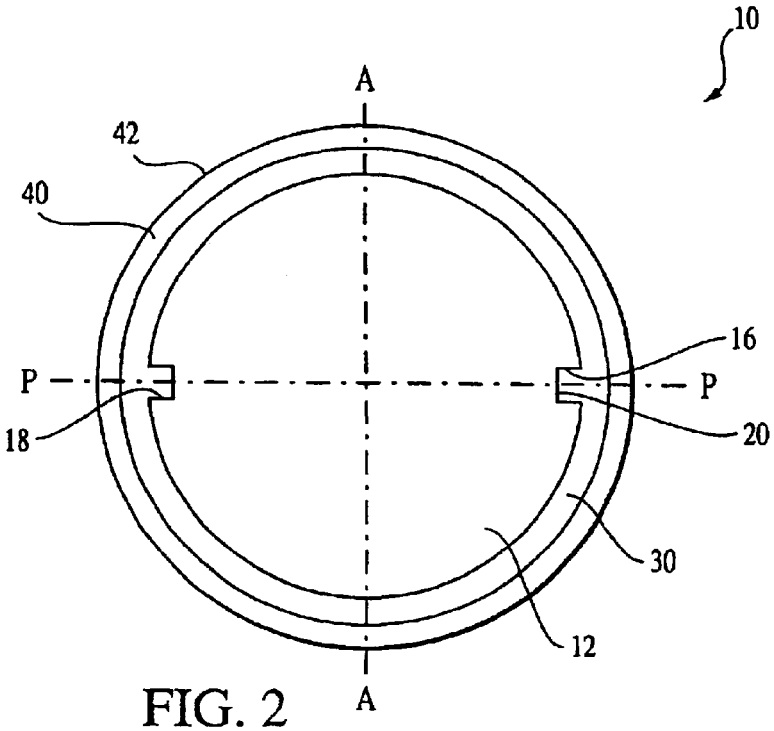
FIG. 2 is a schematic cross-sectional view of the ball of FIG. 1, taken across the midsection of the ball.

Referring now to the FIGURES, wherein like reference numerals are used to denote like or analogous components throughout the several views, FIGS. 1 and 2 illustrate a golf ball construction 10 in accordance with a first illustrated embodiment of the present invention. The golf ball 10 comprises a core 12, a mantle 30 disposed on the core 12, and a cover 40 disposed on the mantle 30. The core 12 defines a recessed region 14 extending about the circumference of the core along a common plane. The recessed region 14 in turn is defined by a channel formed from a recessed inner surface 20 and a pair of opposing walls 16 and 18 extending from the surface 20 to the outer surface of the core 12. The mantle 30, as described in greater detail herein, is formed such that it occupies or extends into the region within the recessed channel extending about the core 12. This aspect is further illustrated in FIG. 2. This portion of the mantle, as described in greater detail herein, forms a longitudinal band extending about the core 12. Moreover, as will be appreciated, the cover layer 40 defines a plurality of dimples 44 defined along the outer surface 42 of the cover 40.

The recessed region 14 defined within the core 12, which in turn enables the formation of the longitudinal band formed of the material constituting the mantle 30, is oriented such that the resulting band extends within the ball's gyroscopic center plane P. The center plane P is perpendicular to the desired or designated spin or rotational axis of the ball, shown in FIGS. 1 and 2 as axis A.

The weight band formed by recessed region 14 is formed of a composite mantle material having a higher density relative to the core body 12. Preferably, the composite mantle material comprises one or more high-density materials incorporated into a polymeric matrix material, which may be the same as or different from the polymer employed in the core body 12.

Irrespective of the material used to form the high density region or band, the core and mantle can be made by a number of methods. For example, the complimentary shape of the core body 12 can be achieved by molding to the desired final shape, or alternatively providing a spherical member and selectively removing material to achieve the desired shape, e.g., by cutting, ablation, and the like.

The mantle can be in the form of either a solid composite material which is molded or cast in the desired pattern, for use with a separately formed core body 12 with a built-in recessed area or to be used in a comolding process. A particulate or fibrous material can be incorporated into the composite as a filler material in the desired regions. The high-density particles may be in the form of powders, granules, flakes, fragments, fibers, whiskers, chopped fibers, milled fibers, and so forth. This is described further in more detail below.

Exemplary high-density materials which may be incorporated in accordance with the present invention to produce the desired weight distribution include, but are not limited to, metals or metal alloys (e.g., solid, powder or other form of bismuth, boron, brass, bronze, cobalt, copper, inconel metal, iron powder, molybdenum, nickel, stainless steel, tungsten, titanium powder, aluminum and the like), metal coated filaments (e.g., nickel, silver, or copper coated graphite fiber or filament and the like), carbonaceous materials (e.g., graphite, carbon black, cotton flock, leather fiber, etc.), aramid fibers (e.g., Kevlar®, Twaron®, or other aramid fibers), alumina, aluminosilicate, quartz, rayon, silica, silicon carbide, silicon nitride, silicon carbonitride, silicon oxycarbonitride, titania, titanium boride, titanium carbide, zirconia toughened alumina, zirconium oxide, black glass ceramic, boron and boron containing particles or fibers (e.g., boron on titania, boron on tungsten, and so forth), boron carbide, boron nitride, ceramics, glass (e.g., A-glass, AR-glass, C-glass, D-glass, E-glass, R-glass, S-glass, S1-glass, S2-glass, and other suitable types of glass), high melting polyolefins (e.g., Spectra® fibers), high strength polyethylene, liquid crystalline polymers, nylon, paraphenylene terephthalamide, polyetheretherketone (PEEK), polyetherketone (PEK), polyacrylonitrile, polyamide, polyarylate fibers, polybenzimidazole (PBI), polybenzothiazole (PBT), polybenzoxazole (PBO), polybenzthiazole (PBT), polyester, polyethylene, polyethylene 2,6 naftalene dicarboxylate (PEN), polyethylene phthalate, polyethylene terephthalate, polyvinyl halides, such as polyvinyl chloride, other specialty polymers, and so forth. Mixtures of any such suitable materials may also be employed in order to obtain the high density desired.

When a particulate high-density material is employed, the particles can range in size from about 5 mesh to about 1 micron, preferably about 20 mesh to about 325 mesh and most preferably about 100 mesh to about 1 micron.

Examples of various suitable heavy filler materials which can be used as the high-density material are listed below.

TABLE 1

| Filler Type | Specific Gravity |
|---|---|
| Metals and Alloys (powders) | |
| titanium | 4.51 |
| tungsten | 19.35 |
| aluminum | 2.70 |
| bismuth | 9.78 |
| nickel | 8.90 |
| molybdenum | 10.2 |
| iron | 7.86 |
| copper | 8.94 |
| brass | 8.2–8.4 |
| boron | 2.364 |
| bronze | 8.70–8.74 |
| cobalt | 8.92 |
| beryllium | 1.84 |
| zinc | 7.14 |
| tin | 7.31 |
| Metal Oxides | |
| zinc oxide | 5.57 |
| iron oxide | 5.1 |
| aluminum oxide | 4.0 |
| titanium dioxide | 3.9–4.1 |
| magnesium oxide | 3.3–3.5 |
| zirconium oxide | 5.73 |
| Metal Stearates | |
| zinc stearate | 1.09 |
| calcium stearate | 1.03 |
| barium stearate | 1.23 |
| lithium stearate | 1.01 |
| magnesium stearate | 1.03 |
| Other | |
| graphite fibers | 1.5–1.8 |
| precipitated hydrated silica | 2.0 |
| clay | 2.62 |
| talc | 2.85 |
| asbestos | 2.5 |
| glass fibers | 2.55 |
| Kevlar ® fibers | 1.44 |
| mica | 2.8 |
| calcium metasilicate | 2.9 |
| barium sulfate | 4.6 |
| zinc sulfide | 4.1 |
| silicates | 2.1 |
| diatomaceous earth | 2.3 |
| calcium carbonate | 2.71 |
| magnesium carbonatel | 2.20 |
| Particulate carbonaceous materials | |
| graphite | 1.5–1.8 |
| carbon black | 1.8 |
| natural bitumen | 1.2–1.4 |
| cotton flock | 1.3–1.4 |
| cellulose flock | 1.15–1.5 |
| leather fiber | 1.2–1.4 |

The amount and type of heavy weight filler material utilized is dependent upon the overall characteristics of the self-correcting golf ball desired. Generally, lesser amounts of high specific gravity materials are necessary to produce a desired weight distribution in comparison to low specific gravity materials. Furthermore, other factors, such as handling and processing conditions, can also affect the type and amount of heavy weight filler material incorporated into the high-density regions.

The term "density reducing filler" as used herein refers to materials having relatively low densities, i.e., that are lightweight or have a specific gravity less than the specific gravity of the base polybutadiene rubber of 0.91. Examples of these materials include lightweight filler materials typically used to reduce the weight of a product in which they are incorporated. Specific examples include, for instance, foams and other materials having a relatively large void volume. Typically, such filler materials have specific gravities less than 1.0. A density-reducing filler can be used in other ball components to offset the weight increase due to the dense material in regions, such as when it is desired to provide a golf ball which is in conformance with weight restrictions. The density-reducing filler can also be used to adjust one or more desired properties, such as the MOI, COR, and others.

The different types of composite materials utilized to form the core, mantle and cover materials are more specifically defined below. However, by creating a core with a peripheral, high-density continuous band around the spin axis A, the finished golf ball produced will exhibit a spin correcting gyroscopic effect. In this regard, the weight band forms a gyroscopic center plane P that is centered about spin axis A as described above. The core 12 and the mantle layer 30 are covered by a single cover layer 40, although multiple cover layers are also contemplated.

The mantle layer 30 should be as thin as possible to maximize the weight concentration in the continuous band. A thick heavy mantle is not desirable as it would reduce the connecting effect and may increase the ball weight beyond the 1.620 ounces maximum USGA ball weight.

Figure 3:
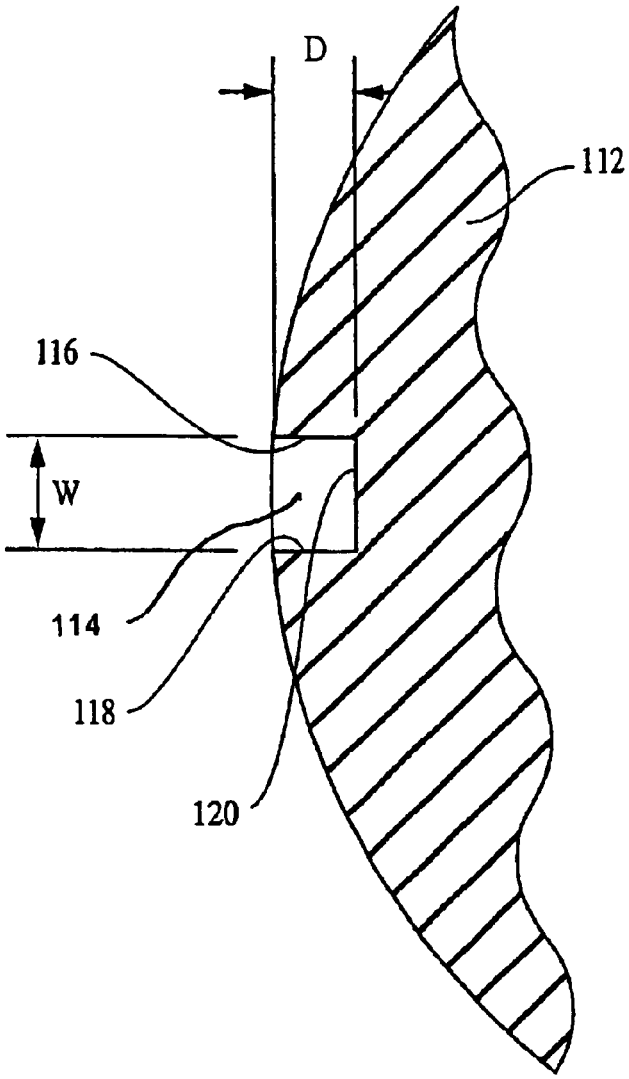
FIG. 3 is a detailed partial cross-sectional view of a preferred core component utilized in the golf balls of the present invention.

FIG. 3 is a detailed partial cross-sectional view of a core 112 defining a recessed region 114 extending about its outer periphery. The recessed region is defined by a pair of opposing walls 116 and 118 and an interior surface 120 extending therebetween. The dimensions of the recessed region formed from walls 116 and 118, and surface 120 may vary depending upon the particular application and properties of the resulting golf ball desired. The depth of the recessed region 114, designated as dimension D, may range from about 0.050 inches to about 0.300 inches. The width of the recessed region, designated as W, may range from about 0.100 inches to about 0.500 inches. Preferably, the width W ranges from about 0.100 inches to about 0.250 inches. It will be appreciated that the present invention includes channels and regions of greater or lesser dimensions.

Furthermore, it is generally preferred that the walls 116 and 118 are parallel with each other and extend at right angles with the surface 120. However, it is contemplated that the angle between either of the walls 116 and 118 with that of the surface 120 may be round or at an angle greater than 90°. Additionally, it is contemplated that the angle between either of the walls 116 and 118 and that of the face 120 may be at an angle less than 90°. This latter configuration would promote interlocking between the core 112 and an adjacent mantle layer extending about the core 112.

Figure 4:
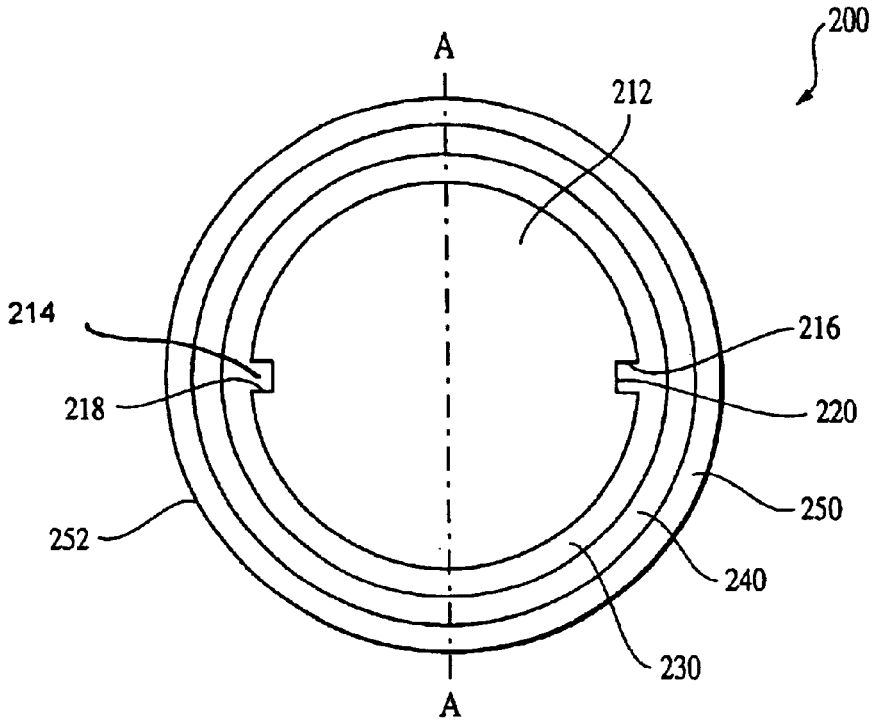
FIG. 4 is a schematic cross-sectional view of another preferred embodiment golf ball in accordance with the present invention.

As previously noted, the present invention includes golf ball embodiments having various combinations of cover layers and core assembly configurations. FIG. 4 illustrates another preferred embodiment golf ball 200. In this embodiment, the golf ball 200 includes a core 212, a mantle 230 disposed on and generally extending about the core 212, a first cover layer 240 disposed on and extending about the mantle 230, and an outer cover layer 250 disposed on the inner cover layer 240. The outer cover layer 250 defines an outer surface 252. As will be appreciated, it is preferred that a plurality of dimples (not shown) are defined along the outer surface 252. The core 212 defines a recessed region 214 extending about the outer periphery of the core 212. The recessed region 214 is defined by a pair of opposing walls 216 and 218, that extend between an inner face 220 and the outer region of the core 212. Again, as previously described, it is preferred that the recessed region formed by walls 216, 218 and face 220 is generally co-planar or extends within the center plane of the ball 200 and therefore is generally oriented at right angles with respect to axis A. The characteristics of the recessed region of the ball 200 are preferably as described with respect to FIG. 3.

Figure 5:
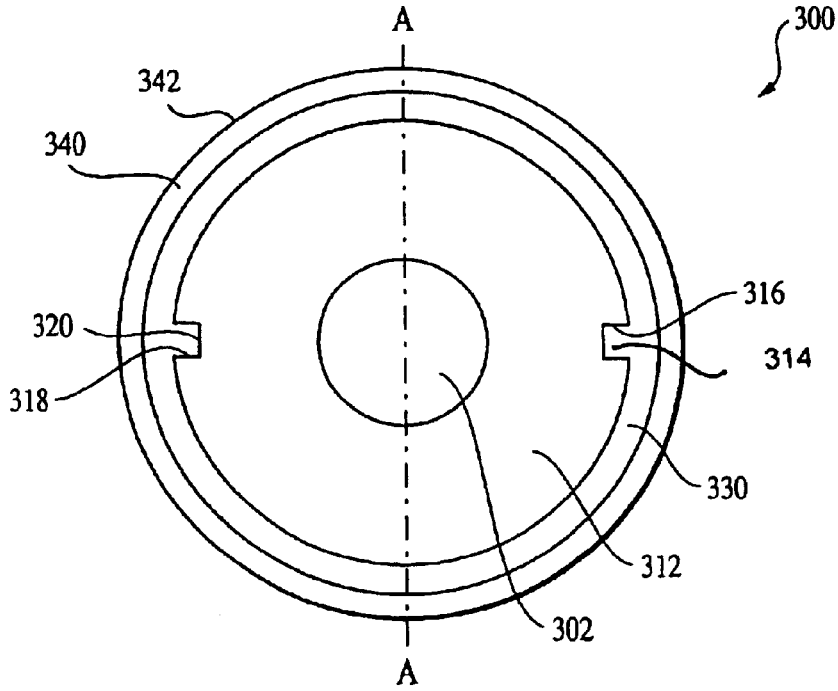
FIG. 5 is a schematic cross-sectional view of yet another preferred embodiment golf ball in accordance with the present invention.

FIG. 5 illustrates another preferred embodiment golf ball 300 in accordance with the present invention. The golf ball 300 includes a center core component 302 and an outer core component 312 disposed on and generally encircling and encapsulating the inner core component 302. The core components 302 and 312 may be selectively tailored to impart particular properties and characteristics to the ball 300. For example, the components 302 and 312 may have different densities, C.O.R.'s and each may be formed from a wide array of materials. The outer core component 312 defines a recessed region 314 extending about its outer periphery and which is defined by a pair of opposing walls 316 and 318 that extend between an inner face surface 320 and the outer region of the core component 312. Disposed on the core assembly of components 302 and 312, is a mantle 330. The golf ball 300 also comprises a cover 340 having an outer surface 342. As will be appreciated, a plurality of dimples (not shown) are defined along the outer surface of the cover 340.

It will be recognized that each of the illustrated embodiments is exemplary and explanatory only. Various other combinations of discrete and continuous bands or channels of high-density material in the composite materials of one or more cover and core layers are also contemplated.

Metal particles, or other heavy weight (high-density) filler materials may be included in the composite materials to form the longitudinal axis region(s) or channel(s) in order to increase the density in these regions to provide the gyroscopic effect. The continuous longitudinal weighted region (s) or channel(s) are configured as annular bands centered about the spin axis as a representative of the gyroscopic center plane, and may be a region doped with a high-density material. The high-density materials preferably have a specific gravity of greater than 1.05, preferably greater than 1.15, more preferably greater than 1.2, and even more preferably greater than 1.3. Particulate materials are provided in an amount ranging from about 1 to about 1500 parts per hundred parts resin (phr), preferably from about 4 to about 1400 phr, and more preferably from about 10 to about 1200 phr.

In certain embodiments, the core, mantle layer, or cover component or components carrying the weighted regions are configured in a manner analogous to conventional components. However, these components are modified to provide the high-density and/or low-density regions.

For example, a core body is compression molded in the typical manner from a slug of uncured or lightly cured elastomer composition comprising a high cis-content polybutadiene and a metal salt of an $\alpha$, $\beta$, ethylenically unsaturated carboxylic acid such as zinc mono or diacrylate or methacrylate. Additives can optionally be added to achieve higher coefficients of restitution in the core. The manufacturer may include a small amount of a metal oxide such as zinc oxide. In addition, larger amounts of metal oxide than those that are needed to achieve the desired coefficient may be included in order to increase the core weight so that the finished ball more closely approaches the USGA upper weight limit of 1.620 ounces. Other materials may be used in the core composition including compatible rubbers or ionomers, and low molecular weight fatty acids such as stearic acid. Free radical initiator catalysts such as peroxides are admixed with the core composition so that on the application of heat and pressure, a complex curing or cross-linking reaction takes place.

Core components having high-density regions can be formed in a number of ways. For example, a core body, i.e., a one-piece solid core, or an outer component of a multilayer core is generally spherical, but with an annular, surface depression or channel, which corresponds to the location of the high-density region. This may be accomplished, for example, by using well-known compression or injection molding techniques with an appropriately shaped mold.

Alternately, a spherical component is first molded and corresponding depressions or channels are subsequently formed at a later stage, by material removal after the core component hardens or solidifies. Material removal is performed, for example, by cutting, grinding, ablation, routing, abrasion, or the like. The high-density regions are then formed in the depressions or channels by filling with a high-density composite material, co-molding with a polymer doped with a high-density filler material, and the like. A co-molding process is advantageous in that a chemical fusion is formed between the parts.

When a multiple core component is produced, the layers are formed by molding processes currently well known in the golf ball art. Specifically, the golf balls can be produced by injection molding, compression molding, or a similar molding technique, an outer core layer about a smaller, previously molded inner core. Likewise, one or more cover layers are molded about the previously molded single or multi-layer cores or mantle assemblies, with the weighted regions, if any, being formed therein in like manner. The cover layer (or outer cover layer in multi-layer cover golf balls) is molded to produce a dimpled golf ball, preferably having a diameter of 1.680 inches or more. After molding, the golf balls produced may undergo various further processing steps such as buffing, painting, marking, and so forth.

The core component comprises one or more layers comprising a matrix material selected from thermosets, thermoplastics, and combinations thereof. When a dual- or multi-layer core is utilized, the matrix material and other formulation components, as described in greater detail below, in the various layers may be the same or different composition. The outer diameter of the core component may vary in size and is preferably from about 1.30 inches to 1.610 inches, and is most preferably from about 1.47 inches to 1.56 inches.

The core compositions and resulting molded core layer or layers of the present invention are manufactured using relatively conventional techniques. In this regard, the core compositions of the invention preferably are based on a variety of materials, particularly the conventional rubber based materials such as cis-1,4 polybutadiene and mixtures of polybutadiene with other elastomers blended together with crosslinking agents, a free radical initiator, specific gravity controlling fillers, and the like.

Natural rubber, isoprene rubber, EPR, EPDM, styrene-butadiene rubber, or similar thermoset materials may be appropriately incorporated into the base rubber composition of the butadiene rubber to form the rubber component. It is preferred to use butadiene rubber as a base material of the composition for the one or more core layers.

Thus, in the embodiments using a multi-layer core, the same rubber composition, including the rubber base, free radical initiator, and modifying ingredients, can be used in each layer. Different specific gravity controlling fillers or amounts can be used to selectively adjust the weight or moment of inertia of the finished golf ball. Different cross-linking agents can be used to adjust the hardness or resiliency of the different core layers. However, different compositions can readily be used in the different layers, including thermoplastic materials such as a thermoplastic elastomer or a thermoplastic rubber, or a thermoset rubber or thermoset elastomer material.

Some examples of materials suitable for use as the one or more core layers further include, in addition to the above materials, polyether or polyester thermoplastic urethanes, thermoset polyurethanes or metallocene polymers, or blends thereof.

Examples of a thermoset material include a rubber based, castable urethane or a silicone rubber. More particularly, a wide array of thermoset materials can be utilized in the core components of the present invention. Examples of suitable thermoset materials include polybutadiene, polyisoprene, styrene/butadiene, ethylene propylene diene terpolymers, natural rubber polyolefins, polyurethanes, silicones, polyureas, or virtually any irreversibly cross-linkable resin system. It is also contemplated that epoxy, phenolic, and an array of unsaturated polyester resins could be utilized.

The thermoplastic material utilized in the present invention golf balls and, particularly the cores, may be nearly any thermoplastic material. Examples of typical thermoplastic materials for incorporation in the golf balls of the present invention include, but are not limited to, ionomers, polyurethane thermoplastic elastomers, and combinations thereof. It is also contemplated that a wide array of other thermoplastic materials could be utilized, such as polysulfones, polyamide-imides, polyarylates, polyaryletherketones, polyaryl sulfones/polyether sulfones, polyether-imides, polyimides, liquid crystal polymers, polyphenylene sulfides; and specialty high-performance resins, which would include fluoropolymers, polybenzimidazole, and ultrahigh molecular weight polyethylenes.

Additional examples of suitable thermoplastics include metallocenes, polyvinyl chlorides, polyvinyl acetates, acrylonitrile-butadiene-styrenes, acrylics, styrene-acrylonitriles, styrene-maleic anhydrides, polyamides (nylons), polycarbonates, polybutylene terephthalates, polyethylene terephthalates, polyphenylene ethers/polyphenylene oxides, reinforced polypropylenes, and high-impact polystyrenes.

Preferably, the thermoplastic materials have relatively high melting points, such as a melting point of at least about 300° F. Several examples of these preferred thermoplastic materials and which are commercially available include, but are not limited to, Capron™ (a blend of nylon and ionomer), Lexan™ polycarbonate, Pebax® polyetheramide and Hytrel™ polyesteramide. The polymers or resin systems may be cross-linked by a variety of means, such as by peroxide agents, sulphur agents, radiation, or other crosslinking techniques, if applicable. However, the use of peroxide crosslinking agents is generally preferred in the present invention.

Any or all of the previously described components in the cores of the golf ball of the present invention may be formed in such a manner, or have suitable fillers added, so that their resulting density is decreased or increased.

The core component of the present invention is manufactured using relatively conventional techniques. In this regard, the preferred compositions for the one or more core layers of the invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers such as polyisoprene may also be utilized. Most preferably, cis-polybutadiene having a weight-average molecular weight of from about 100,000 to about 500,000 is employed. Elastomers are commercially available and are well known in the golf ball art.

Metal carboxylate crosslinking agents are optionally included in the one or more core layers. The unsaturated carboxylic acid component of the core composition (a co-crosslinking agent) is the reaction product of the selected carboxylic acid or acids and an oxide or carbonate of a metal, such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 12 to about 40, and preferably from about 15 to about 35 parts by weight of the carboxylic acid salt, such as zinc diacrylate, is included in the one or more core layers. The unsaturated carboxylic acids and metal salts thereof are generally soluble in the elastomeric base, or are readily dispersed.

The free radical initiator included in the core compositions is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides are readily commercially available and known in the art. They are conveniently used in the present invention, generally in amounts of from about 0.5 to about 4.0 and preferably in amounts of from about 1.0 to about 3.0 parts by weight per each 100 parts of elastomer and based on 40% active peroxide with 60% inert filler.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

The core compositions of the present invention may additionally contain any other suitable and compatible modifying ingredients including, but not limited to, metal oxides, fatty acids, diisocyanates, and polypropylene powder resin.

Various activators may also be included in the compositions of the present invention. For example, zinc oxide, calcium oxide and/or magnesium oxide are activators for the polybutadiene. The activator can range from about 2 to about 30 parts by weight per 100 parts by weight of the rubbers (phr) component.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 2 to about 15 parts by weight based on 100 parts rubber (elastomer).

It is preferred that the core compositions include zinc stearate as the metallic salt of a fatty acid in an amount of from about 2 to about 20 parts by weight per 100 parts of rubber.

Diisocyanates may also be optionally included in the core compositions. The diisocyanates act here as moisture scavengers. When utilized, the diioscyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference in its entirety.

The preferred core components of the invention are generally comprised of 100 parts by weight of a base elastomer (or rubber) selected from polybutadiene and mixtures of polybutadiene with other elastomers, such as polyisoprene, 12 to 40 parts by weight of at least one metallic salt of an unsaturated carboxylic acid, and 0.5 to 4.0 parts by weight of a free radical initiator (40% active peroxide). However, as mentioned above, the use of at least one metallic salt of an unsaturated carboxylic acid is preferably not included in the formulation of the high-density center core layer.

In addition to polybutadiene, the following commercially available thermoplastic resins are also particularly suitable for use in the noted dual cores employed in the golf balls of the present invention: Capron™ 8351 (available from Allied Signal Plastics), Lexan™ ML5776 (from General Electric), Pebax® 3533 (a polyether block amide from Elf Atochem), and Hytrel™ G4074 (a polyether ester from DuPont).

In addition, various polyisoprenes may also be included in the core components of the present invention.

As mentioned above, the present invention includes golf ball embodiments that utilize one or more core components. For multiple-component cores, a core assembly is provided that comprises a central core component and one or more core layers disposed about the central core component. The second, third, and higher numbers of core layers may be the same as or different from each other and the central core layer.

In producing the golf ball single component cores, and the center or outer layers of multi-component cores, the desired ingredients are intimately mixed, for instance, using two roll mills or a Banbury™ mixer until the composition is uniform, usually over a period of from about 5 to about 20 minutes. The sequence of addition of components is not critical. A preferred blending sequence is described below.

The matrix material or elastomer, powdered metal zinc salt (if desired), a high specific gravity additive such as powdered metal (if desired), a low specific gravity additive (if desired), metal oxide, fatty acid, and the metallic dithiocarbamate (if desired), surfactant (if desired), and tin difatty acid (if desired), are blended for about 7 minutes in an internal mixer such as a Banbury™ mixer. As a result of shear during mixing, the temperature rises to about 200° F. The mixing is desirably conducted in such a manner that the composition does not reach incipient polymerization temperatures during the blending of the various components. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell™ preformer and slugs of the desired weight are produced. The slugs to be used for the core (or center core layer) are then subjected to compression molding at about 140° C. to about 170° C. for about 10 to 50 minutes. Note that the temperature in the molding process is not always required to be constant, and may be changed in two or more steps. In fact, the slugs for the outer core layer are frequently preheated for about one-half hour at about 75° C. prior to molding. After molding, the molded cores (or center layer thereof for multi-component cores) are cooled, the cooling effected, for example, at room temperature for about 4 hours or in cold water for about one hour. The molded cores/center core layers are subjected to a centerless grinding operation whereby a thin layer of the molded core is removed to produce a round center. Alternatively, the cores/center layers are used in the as-molded state with no grinding needed to achieve roundness.

The center is converted into a dual- or multi-layer core by providing at least one layer of core material thereon, which again, may be of similar or different matrix material as the center. Preferably, the outer core layer(s), where present, comprises polybutadiene. Optionally, for example, where a golf ball meeting specified weight requirements is desired, one or more of the inner and outer core layers are weight-adjusted to compensate for the spin-correcting, high-density equatorial regions.

In producing a multi-component core, the one or more outer core layers can be applied around the spherical center by several different types of molding processes. For example, the compression molding process for forming the cover layer(s) of a golf ball that is set forth in U.S. Pat. No. 3,819,795, incorporated herein by reference in its entirety, can be adapted for use in producing the core layer(s) of the present invention.

In such a modified process, preforms or slugs of the outer core material, i.e., the thermoset material utilized to form the outer core layer, are placed in the upwardly open, bottom cavities of a lower mold member of a compression molding assembly, such as a conventional golf ball or core platen press. The upwardly facing hemispherical cavities have inside diameters substantially equal to the finished core to be formed. In this regard, the inside diameters of the cavities are slightly larger (i.e., approximately 2.0 percent larger) than the desired finished core size in order to account for material shrinkage.

An intermediate mold member comprising a center Teflon®-coated plate having oppositely-affixed hemispherical protrusions extending upwardly on the upper surface and extending downwardly on the lower surface, each hemispherical protrusion sized to be substantially equal to the centers to be utilized and thus can vary with the various sizes of the centers to be used.

Additional preforms of the same outer core material are subsequently placed on top of the upwardly-projecting hemispherical protrusions affixed to the upper surfaces of the Teflon®-coated plate of the intermediate mold member. The additional preforms are then covered by the downwardly open cavities of the top mold member. Again the downward facing cavities of the top mold member have inside diameters substantially equal to the core to be formed.

Specifically, the bottom mold member is engaged with the top mold member with the intermediate mold member having the oppositely protruding hemispheres being present in the middle of the assembly. The mold members are then compressed together to form hemispherical core halves.

In this regard, the mold assembly is placed in a press and cold formed at room temperature using approximately 10 tons of pressure in a steam press. The molding assembly is closed and heated below the cure activation temperature of about 150° F. for approximately four minutes to soften and mold the outer core layer materials. While still under compression, but at the end of the compression cycle, the mold members are water cooled to a temperature to less than 100EF in order to maintain material integrity for the final molding step. This cooling step is beneficial since cross linking has not yet proceeded to provide internal chemical bonds to provide full material integrity. After cooling, the pressure is released.

The molding assembly is then opened, the upper and lower mold members are separated, and the intermediate mold member is removed while maintaining the formed outer core layer halves in their respective cavities. Each of the halves has an essentially perfectly formed one-half shell cavity or depression in its uncured thermoset material. These one-half shell cavities or depressions were produced by the hemispherical protrusions of the intermediate mold member. Previously molded centers are then placed into the bottom cavities or depressions of the uncured thermoset material. The top portion of the molding assembly is subsequently engaged with the bottom portion and the material that is disposed therebetween is cured for about 12 minutes at about 320° F. Those of ordinary skill in the art relating to free radical curing agents for polymers are conversant with adjustments of cure times and temperatures required to effect optimum results with any specific free radical agent. The combination of the high temperature and the compression force joins the core halves, and bonds the cores to the center. This process results in a substantially continuously outer core layer being formed around the center component.

In an alternative, and in some instances, more preferable compression molding process, the Teflon®-coated plate of the intermediate mold member has only a set of downwardly projecting hemispherical protrusions and no oppositely affixed upwardly-projecting hemispherical protrusions. Substituted for the upwardly-projecting protrusions are a plurality of hemispherical recesses in the upper surface of the plate. Each recess is located in the upper surface of the plate opposite a protrusion extending downwardly from the lower surface. The recess has an inside diameter substantially equal to the center to be utilized and is configured to receive the bottom half of the center.

The previously molded centers are then placed in the cavities located on the upper surface of the plate of the intermediate mold member. Each of the centers extends above the upper surface of the plate of the intermediate mold member and is pressed into the lower surface of the upper preform when the molds are initially brought together during initial compression.

The molds are then separated and the plate removed, with the centers being retained (pressed into) the half shells of the upper preforms. Mating cavities or depressions are also formed in the half shells of the lower preforms by the downwardly projecting protrusions of the intermediate mold member. With the plate now removed, the top portion of the molding assembly is then joined with the bottom portion. In so doing, the centers projecting from the half shells of the upper performs enter into the cavities or depressions formed in the half shells of the lower preforms. The material included in the molds is subsequently compressed, treated and cured as stated above to form a golf ball core having a centrally located center and an outer core layer. This process can continue for any additional added core layers.

After molding, the core (optionally surrounded by one or more outer core layers) is removed from the mold and the surface thereof preferably is treated to facilitate adhesion thereof to the covering materials. Surface treatment can be effected by any of the several techniques known in the art, such as corona discharge, ozone treatment, sand blasting, brush tumbling, and the like. Preferably, surface treatment is effected by grinding with an abrasive wheel.

As stated above, the golf balls of the subject invention may include a mantle and/or a cover, which may comprise a single layer or multiple layers.

The mantle compositions and resulting mantle layers of the present invention are produced as follows. In this regard, mantle compositions of the invention preferably are based on a variety of materials, particularly the conventional rubber based materials such as cis-1,4 polybutadiene and mixtures of polybutadiene with other elastomers blended together with crosslinking agents, a free radical initiator, specific gravity controlling fillers and the like. Materials previously discussed for use in the core can also be used in the mantle.

Any or all of the previously described components in the core or mantle of the golf ball of the present invention may be formed in such a manner, or have suitable fillers added, so that their resulting density is decreased or increased. For example, heavy weight metals and/or filler materials are incorporated into the mantle or core.

As noted herein, the specific gravity of the mantle layer may be either greater than or less than the specific gravity of the core. For embodiments in which the mantle layer has a higher specific gravity than the core, by increasing the specific gravity of the mantle, weight is added to the mantle material disposed in the channel defined in the core. The specific gravity of the core may be adjusted, i.e. decreased, to accommodate for the additional weight in the mantle. Ionomer-based mantles may exhibit specific gravities of about 1.00 while conventional polybutadiene cores may exhibit a specific gravity of about 1.15. The specific gravity of a core with an adjusted specific gravity may be as low as about 1.06. In some versions, the mantle layer is formed as thin as possible to produce a finished ball weight of 46 grams or less. Alternatively, the specific gravity of the core may be increased relative to that of the mantle layer. The increased weight of the core will assist in orienting the core during ball flight.

Referring now to dual- and multi-layer covers, the inner cover layer is preferably in one embodiment harder than the outer cover layer and generally has a thickness in the range of 0.01 to 0.10 inches, preferably 0.03 to 0.07 inches for a 1.68 inch ball and 0.05 to 0.10 inches for a 1.72 inch (or more) ball. The core and inner cover layer together form an inner ball having a coefficient of restitution of 0.780 or more and more preferably 0.790 or more, and a diameter in the range of 1.48–1.64 inches for a 1.68 inch ball and 1.50–1.70 inches for a 1.72 inch (or more) ball. The above-described characteristics of the inner cover layer provide an inner ball having a PGA compression of 100 or less. It is found that when the inner ball has a PGA compression of 90 or less, excellent playability results.

Materials suitable for the inner cover layer are known in the art. Examples of suitable materials for the inner layer compositions include the high acid and low acid ionomers such as those developed by E.I. DuPont de Nemours & Company under the trademark "Surlyn®" and by Exxon Corporation under the trademark "Escor™" or trade name "lotek", or blends thereof. Examples of compositions which may be used as the inner layer herein are set forth in detail in U.S. application Ser. No. 09/505,760 (U.S. Pat. No. 6,433,094) which is a continuation-in-part of U.S. application Ser. No. 09/918,860 (U.S. Pat. No. 6,494,792), which is a divisional of U.S. application Ser. No. 08/896,690 (U.S. Pat. No. 6,267,693) which is a continuation of U.S. application Ser. No. 08/174,765, which is a continuation of U.S. application Ser. No. 07/776,803 filed Oct. 15, 1991, and Ser. No. 08/493,089 (U.S. Pat. No. 5,688,869), which is a continuation of Ser. No. 07/981,751, which in turn is a continuation of Ser. No. 07/901,660 filed Jun. 19, 1992, each of which is incorporated herein by reference in its entirety. Of course, the inner layer high acid ionomer compositions are not limited in any way to those compositions set forth in said applications. Additional materials suitable for use as the inner cover layer include low acid ionomers, which are known in the art. Other materials suitable for use as the inner cover layer include fully non-ionomeric thermoplastic materials. Suitable non-ionomeric materials include metallocene catalyzed polyolefins or polyamides, polyamide/ionomer blends, polyphenylene ether/ionomer blends, etc., which have a Shore D hardness of 60 or more and a flex modulus of greater than about 30,000 psi, or other hardness and flex modulus values which are comparable to the properties of the ionomers described above. Other suitable materials include but are not limited to thermoplastic or thermosetting polyurethanes, a polyester elastomer such as that marketed by DuPont under the trademark Hytrel™ (polyester amide), or a polyether amide such as that marketed by Elf Atochem S.A. under the trademark Pebax®, a blend of two or more non-ionomeric thermoplastic elastomers, or a blend of one or more ionomers and one or more non-ionomeric thermoplastic elastomers.

Still referring to embodiments having dual- or multi-layer covers, the core component or core and mantle assembly, and the hard inner cover layer formed thereon provide the subject golf ball with power and distance. The outer cover layer is preferably comparatively softer than the inner cover layer. The softness provides for the feel and playability characteristics typically associated with balata or balata-blend balls. The outer cover layer or ply is comprised of a relatively soft, low modulus (about 1,000 psi to about 10,000 psi) and, in an alternate embodiment, low acid (less than 16 weight percent acid) ionomer, an ionomer blend, a non-ionomeric thermoplastic or thermosetting material such as, but not limited to, a metallocene catalyzed polyolefin such as EXACT™ material available from EXXON®, a polyurethane, a polyester amide elastomer such as that marketed by DuPont under the trademark Hytrel™, or a polyether amide such as that marketed by Elf Atochem S.A. under the trademark Pebax®, a blend of two or more non-ionomeric thermoplastic or thermosetting materials, or a blend of one or more ionomers and one or more non-ionomeric thermoplastic materials.

The outer layer is fairly thin (i.e. from about 0.010 to about 0.10 inches in thickness, more desirably 0.03 to 0.06 inches in thickness for a 1.680 inch ball and 0.03 to 0.06 inches in thickness for a 1.72 inch or more ball), but thick enough to achieve desired playability characteristics while minimizing expense. Thickness is defined as the average thickness of the non-dimpled areas of the outer cover layer. Preferably, the outer cover layer has a Shore D hardness of at least 1 point softer than the inner cover, although the outer layer may be the same or harder than the inner layer in some embodiments.

The outer cover layer of the invention is formed over a core to result in a golf ball having a coefficient of restitution of at least 0.760, more preferably at least 0.770, and most preferably at least 0.780. The coefficient of restitution of the ball will depend upon the properties of both the core and the cover. The PGA compression of the golf ball is 100 or less, and preferably is 90 or less.

Additional materials may also be added to the inner and outer cover layer of the present invention as long as they do not substantially reduce the playability properties of the ball. Such materials include dyes (for example, Ultramarine Blue™ sold by Whitaker, Clark, and Daniels of South Plainsfield, N.J.) (see U.S. Pat. No. 4,679,795), pigments such as titanium dioxide, zinc oxide, barium sulfate and zinc sulfate; UV absorbers; optical brighteners such as Eastobrite™ OB-1 and Uvitex™ OB antioxidants; antistatic agents; and stabilizers. Moreover, the cover compositions of the present invention may also contain softening agents such as those disclosed in U.S. Pat. Nos. 5,312,857 and 5,306,760, including plasticizers, metal stearates, processing acids, etc., and reinforcing materials such as glass fibers and inorganic fillers, as long as the desired properties produced by the golf ball covers of the invention are not impaired.

It will be appreciated that the present invention provides at least two (2) strategies for improving the spin characteristics of a golf ball. The first technique is to decrease the specific gravity of a core having a channel extending about its outer periphery while increasing the specific gravity of a mantle layer immediately adjacent and alongside the core. Alternatively, another technique is to increase the specific gravity of the core having the equatorial channel defined about its outer periphery while decreasing the specific gravity of the mantle component immediately adjacent to the core.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims and the equivalents thereof.

Having thus described the preferred embodiments, the invention is now claimed to be:

1. A golf ball exhibiting stable spin characteristics, said golf ball comprising:

a generally spherical core, said core defining a recessed region extending about an outer periphery of said core along a common plan;

a mantle layer disposed on and uniformly encapsulating said core, said mantle layer extending into said recessed region; and a cover disposed on said mantle layer, said cover having an outer surface and defining a plurality of dimples along said outer surface;

wherein said recessed region has a depth of from about 0.050 inches to about 0.300 inches; and, wherein the specific gravity of the mantle is greater than the specific gravity of the core.

2. The golf ball of claim 1, wherein said cover includes an inner cover disposed on said mantle and an outer cover disposed on said inner cover, said outer cover providing said outer surface.

3. The golf ball of claim 1, wherein the recessed region is a continuous channel extending about the circumference of the core.

4. The golf ball of claim 1, wherein the specific gravity of said mantle layer is greater than 1.05.

5. The golf ball of claim 1, wherein the specific gravity of said mantle layer is greater than 1.15.

6. The golf ball of claim 1, wherein the specific gravity of said mantle layer is greater than 1.20.

7. A golf ball exhibiting limited side-spin characteristics, said golf ball comprising:

a generally spherical core, said core defining a recessed channel extending about an outer periphery of said core along a common plane;

a mantle layer disposed on and uniformly encapsulating said core, said mantle layer extending into said recessed channel; and a cover disposed on said mantle layer, said cover having an outer surface and defining a plurality of dimples along said outer surface;

wherein said recessed channel has a width of from about 0.100 inches to about 0.500 inches; and wherein the specific gravity of the mantle is greater than the specific gravity of the core to produce a coutinuous band of high density material positioned along the gyroscopic center plane of the golf ball.

8. The golf ball of claim 7, wherein said cover includes an inner covet disposed on said mantle and an outer cover providing said outer surface.

9. The golf ball of claim 7, wherein the specific gravity of said mantle layer is 0.05 or more, greater than the specific gravity of said core.

10. The golf ball of claim 7, wherein the specific gravity of said mantle layer is 0.10 or more, greater than the specific gravity of said core.

11. The golf ball of claim 7, wherein the specific gravity of said mantle layer is 0.15 or more, greater than the specific gravity of the core.

12. The golf ball of claim 7, wherein the mantle layer comprises a density increasing filler.

13. The golf ball of claim 7, wherein the mantle layer comprises a polymeric material and particulate weighting material dispersed therein.

14. A golf ball having a controlled weight distribution about a designated spin axis, said golf ball comprising:

a generally spherical core, said core defining a continuous recessed channel extending about an outer periphery and along the circumference of said core along a common plane and centered about the spin axis of the ball, said core having a density of 1.15 or less;

a mantle layer disposed on and generally encapsulating said core, said mantle layer extending into said recessed channel, said mantle having a density of greater than 1.15; and a cover disposed on said mantle layer, said cover having an outer surface and defining a plurality of dimples along said outer surface.

15. The golf ball of claim 14, wherein said recessed channel has a depth of from about 0.050 inches to about 0.300 inches and a width of from about 0.100 inches to about 0500 inches.

16. The golf ball of claim 14, wherein said cover includes an inner cover disposed on said mantle and an outer cover providing said outer surface.

17. The golf ball of claim 14, wherein said core component includes a central core element disposed at the center of said core component.

18. The golf ball of claim 14, wherein said core has a specific gravity of 1.10 or less and said mantle has a specific gravity of greater than 1.20.

* * * * *